US005669238A

United States Patent [19]

Devers

[11] Patent Number: 5,669,238

[45] Date of Patent: Sep. 23, 1997

[54] HEAT EXCHANGER CONTROLS FOR LOW TEMPERATURE FLUIDS

[75] Inventor: Barnard J. Devers, Greenville, Tex.

[73] Assignee: Phillips Petroleum Company, Bartlesville, Okla.

[21] Appl. No.: 621,923

[22] Filed: Mar. 26, 1996

[51] Int. Cl.[6] ..... F25J 3/00

[52] U.S. Cl. ..... 62/657; 62/618; 62/183

[58] Field of Search ..... 62/618, 657, 185

[56] References Cited

U.S. PATENT DOCUMENTS

| | | | |
|---|---|---|---|
| 3,212,277 | 10/1965 | Harper et al. | 62/657 |
| 3,212,278 | 10/1965 | Huddleston | 62/657 |
| 3,407,052 | 10/1968 | Huntress et al. | 62/657 X |
| 3,413,816 | 12/1968 | DeMarco | 62/657 X |
| 3,707,066 | 12/1972 | Carne et al. . | |
| 4,142,876 | 3/1979 | Zahn et al. | 62/657 X |
| 4,185,978 | 1/1980 | McGalliard et al. . | |
| 4,410,342 | 10/1983 | Horton | 62/618 |
| 4,430,103 | 2/1984 | Gray et al. . | |
| 4,457,768 | 7/1984 | Bellinger . | |

FOREIGN PATENT DOCUMENTS

| | | | |
|---|---|---|---|
| 1043442 | 9/1983 | U.S.S.R. | 62/657 |

OTHER PUBLICATIONS

Liptak, B.G. "Instrument Engineers Handbook", vol. II, pp. 48–49.

Liptak, B.G. "Instrument Engineers Handbook", vol. II, pp. 940–942.

*Primary Examiner*—Christopher Kilner
*Attorney, Agent, or Firm*—George E. Bogatie

[57] ABSTRACT

In a heat exchange scheme associated with a gas purification column in an LNG recovery process, in which heat exchange is desired between fluids of such widely different temperatures that thermal shock could result in damage to heat exchanger apparatus, a control scheme compensates for the effect of excessive temperature differential. The desired compensation is achieved by manipulating flow in a heat exchanger bypass conduit for the warm fluid to maintain a desired temperature ratio between the colder fluid entering the heat exchanger and the warmer fluid exiting the exchanger. Additionally, start-up controls for the column include temporarily selecting temperature of a cold stream to automatically control opening of a valve to initiate flow of the warm stream.

8 Claims, 2 Drawing Sheets

HEAT EXCHANGER CONTROLS FOR LOW TEMPERATURE FLUIDS

The present invention relates to manufacture of LNG from natural gas, and more particularly to method and apparatus for temperature control of a heat exchanger associated with a cryogenic separation column included in the LNG liquefaction process.

BACKGROUND OF THE INVENTION

Natural gas liquefaction by cryogenic cooling is practiced at remote natural gas rich locations to convert the natural gas to a transportable liquid for shipment to available markets. In a typical refrigeration process used to cool a process stream of natural gas, a refrigerant such as propane is compressed, then condensed to a liquid and the liquid is passed to a chiller for heat exchange with a natural gas feedstream. The refrigeration cycle is then repeated. Often the cooling medium is more than one external refrigerant, and also a portion or portions of the cold gases or liquids produced in the process. A preferred process is a cascade system, consisting of three chilling cycles using a different refrigerant for each cycle. For example a cascade of propane, ethylene, and methane cycles may be used, where each cycle further reduces the temperature of the natural gas feedstream until the gas liquefies. The subcooled liquid is then flashed or subjected to a reduced pressure, to produce LNG at approximately atmospheric pressure. A highly effective process for recovery of LNG from natural gas is illustrated and described in U.S. Pat. No. 4,430,103 which is incorporated herein by reference.

While natural gas predominates in methane, such gases often contain a benzene contaminant along with other heavy hydrocarbon contaminants. For technical and economic reasons it is not necessary to remove impurities such as benzene completely. It is, however, desirable to reduce its concentration. Contaminant removal from natural gas may be accomplished by the same type of cooling used in the liquefaction process where the contaminants condense in accordance with their respective condensation temperatures. Except for the fact that the gas must be cooled to a lower temperature to liquefy, as opposed to separating the benzene contaminant, the basic cooling techniques are the same for liquefaction and separation. Accordingly, in respect of residual benzene, it is only necessary to cool the natural gas to a temperature at which a portion of the feed gas is condensed. This may be accomplished in a cryogenic separation column included at an appropriate point in the LNG recovery process to separate the condensed benzene from the main gas stream.

In the interest of efficient operation of the cryogenic separation column, it is desirable to utilize the condensed liquid at cryogenic temperatures, that must be with&am from the column, for heat exchange with a warm dry gas stream provided to the cryogenic separation column. This heat exchange scheme, however, presents a problem resulting from the excessive temperature differential of the two streams supplied to the heat exchanger. Since the actual temperature difference could exceed 100° F., the thermal shock to the heat exchanger could damage or shorten useful life of the heat exchanger apparatus constructed of conventional materials.

Another consideration related to efficient operation of a cryogenic separation column is providing heat exchanger controls that allow automatic start-up of the column.

Accordingly it in an object of this invention to provide heat exchanger controls which overcome the above-mentioned and other associated problems in handling low temperature fluids.

Another object of this invention is to provide an improved control method which reduces initial equipment temperature requirements, and costs for heat exchange apparatus.

A more specific object is to control heat exchanger temperatures to allow cooling of a warm fluid stream against a low temperature fluid stream without introducing thermal shock to the heat exchange apparatus.

A still further object of this invention is to control the heat exchanger to facilitate automatic start-up of a cryogenic separation column.

SUMMARY OF THE INVENTION

According to this invention, the foregoing and other objectives and advantages are achieved in controlling a heat exchanger handling a low temperature fluid and a warm fluid by providing a by-pass conduit for the warm fluid, wherein a control valve in the by-pass conduit is manipulated responsive to the temperature ratio of the heat exchange fluids. In accordance with another aspect of the invention automatic start-up controls include a high selector for temporarily selecting a temperature to manipulate flow of the warm fluid that facilitates start-up of the column, and then switches to manipulation of the warm gas flow responsive to a desired temperature.

Additional objects, advantages, and novel features of the invention will become apparent upon examination of the claims as well as the detailed description and drawings.

BRIEF DESCRIPTIONS OF THE DRAWINGS

The present invention can be best understood by reference to the drawings wherein.

DETAILED DESCRIPTION OF THE PREFERRED EMBODIMENT

Feedback control systems are widely used to achieve efficient operation of LNG plants by controlling the perturbations normally encountered in the operation of various units. Such perturbations occur for example due to upsets in the operation of certain equipment in the plant, adjustment of operating conditions by plant operators, changes in production rates, and the like. In these feedback control systems a plurality of parameters including pressures, temperatures, flow rates, and liquid level at specific locations in the process are controlled at desired set points by measuring each parameter, determining the deviation of each parameter from its set point and using the value of the deviation to manipulate a final control element such as a valve located somewhere in the process that will minimize the deviation of each measured parameter from its set point.

Figure 1:
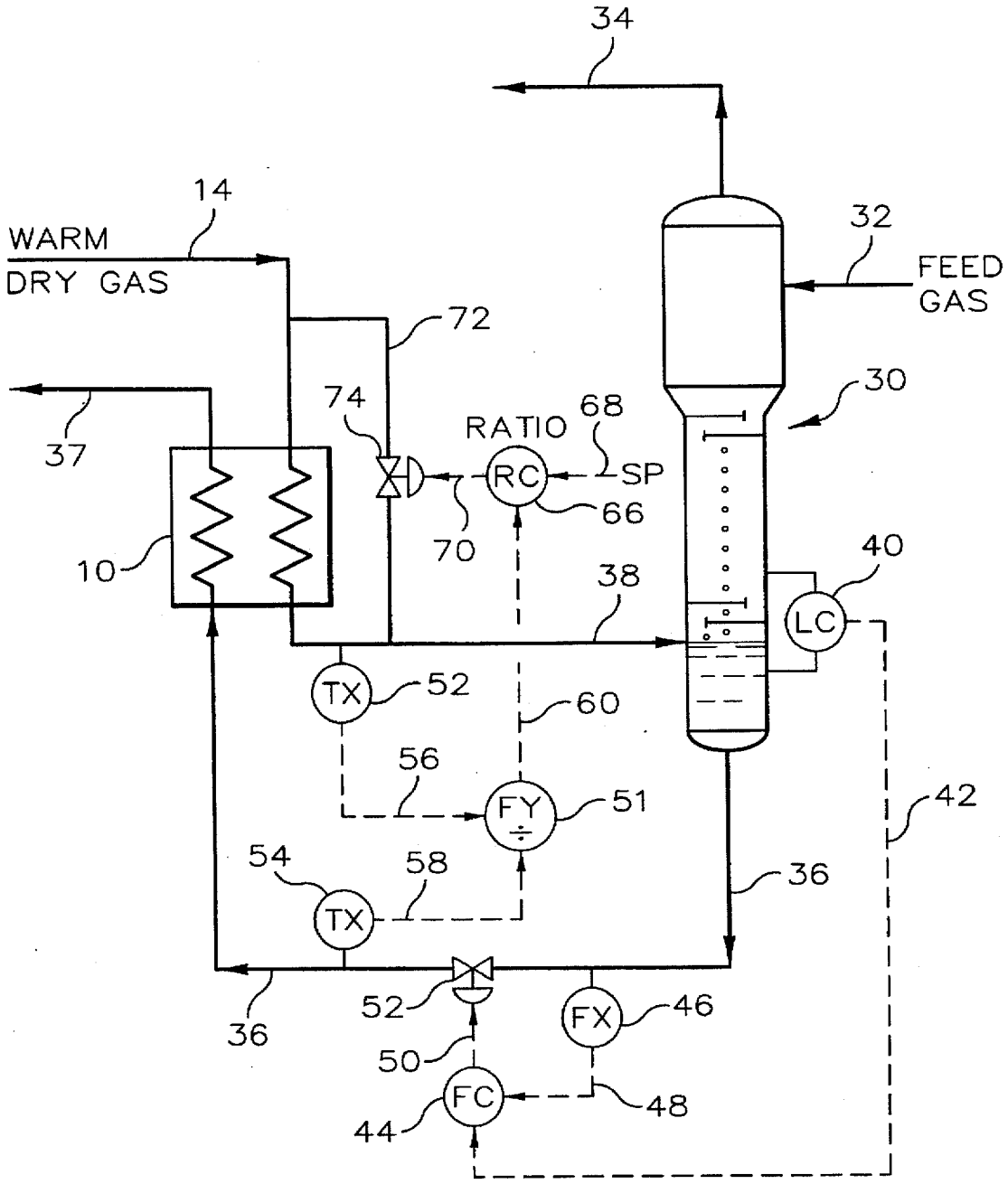
FIG. 1 is a diagrammatic illustration of a cryogenic separation column and the associated control system of the present invention for maintaining a desired temperature ratio for the heat exchange fluids.
Figure 2:
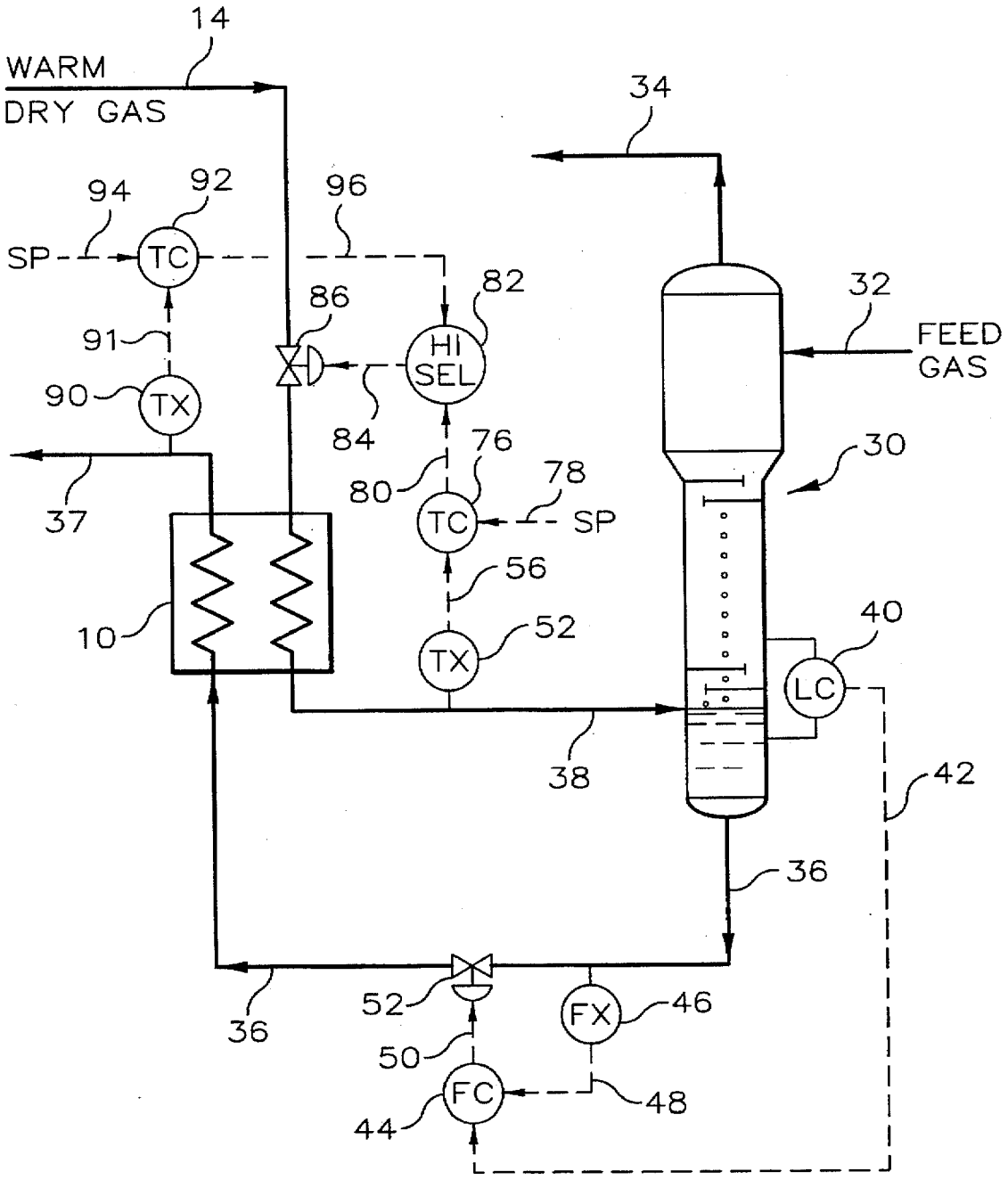
FIG. 2 is a diagrammatic illustration similar to FIG. 1 for temporarily selecting a temperature that will allow automatic start-up of the cryogenic separation column.

A specific control system configuration is set forth in FIG. 1 and FIG. 2 for the sake of illustration, however, the invention extends to different types of control system configurations which accomplish the purpose of the invention. Lines designated as signal lines, which are showing as dash lines in the drawings, are electrical or pneumatic in this preferred embodiment. Generally the signals provided from any transducer are electric in form. However, the signals provided from flow sensors are generally pneumatic in form. The transducing of these signals is not illustrated for the sake of simplicity because it is well known in the art that if a flow is measured in pneumatic form it must be transduced to electric form if it is to be transmitted in electrical form by a flow transducer.

The invention is also applicable to mechanical, hydraulic or other means for transmitting information. In almost all control systems some combination of electrical, pneumatic, or hydraulic signals will be used. However, the use of any other type of signal transmission compatible with the process and equipment in use is within the scope of the invention.

A digital computer having backup accommodations may be used in the preferred embodiment of this invention to calculate the required control signals based on measured process variables as well as set points supplied to the computer. Any digital computer having software that allows operation of a real time environment for reading values of external variables and transmitting signals to external devices is suitable for use in the invention. The PID controllers shown in FIG. 1 and FIG. 2 can utilize the various modes of control such as proportional, proportional-integral or proportional-integral-derivative. In the preferred embodiment a proportional-integral mode is utilized. However, any controller having capacity to accept two or more input signals and produce a scaled output signal representative of the comparison of the two input signals is within the scope of the invention.

The scaling of an output signal by a controller is well known in the control systems art. Essentially, the output of a controller can be scaled to represent any desired factor or variable. An example of this is where a desired temperature and an actual temperature are compared by controller. The controller output might be a signal representative of a flow rate of a "control" gas necessary to make the desired and actual temperatures equal. On the other hand, the same output signal could be scaled to represent a pressure required to make the desired and actual temperatures equal. If the controller output can range from 0–10 units, then the controller output signal could be scaled so that an output having a level of 5 units corresponds to 50% percent or a specified flow rate or a specified temperature. The transducing means used to measure parameters which characterize a process in the various signals generated thereby may take a variety of forms or formats. For example the control elements of this system can be implemented using electrical analog, digital electronic, pneumatic, hydraulic, mechanical, or other similar types of equipment or combination of such types of equipment.

Selective control loops are used in a variety of process situations for selecting an appropriate control action. Typically a normal control signal is overridden by a secondary control signal that has a higher priority in the event of certain process conditions. For example, hazardous conditions can be avoided, or desirable features such as automatic start-up can be implemented by temporarily selecting a secondary control signal.

The specific hardware and/or software utilized in such feedback control systems is well known in the field of process plant control. See for example Chemical Engineering's Handbook, 5th Ed., McGraw-Hill, pgs. 22–1 to 22–147.

Returning now to FIG. 1, there is illustrated a simplified flow diagram for a cryogenic separation column 30 and a temperature control apparatus for an associated heat exchanger 10. This column 30 receives a feed gas comprising natural gas via conduit 32, introduced into the top section of column 30 for the purpose of separating a contaminant such as benzene from the feedstream. The column is maintained at an appropriate temperature and pressure such that essentially all of the methane is separated and is withdrawn overhead as a vapor via conduit 34, while liquid condensate containing major portion of benzene contaminant is withdrawn from the bottom of column 30 via conduit 36. A dry gas stream is introduced into the lower portion of column 30 via conduit 38.

The heat exchanger 10 is provided with a cooling fluid which is the liquid condensate stream at cryogenic temperatures, flowing in conduit 36. A warm dry gas stream provided to heat exchanger 10 via conduit 14 is passed in heat exchange with the low temperature liquid in conduit 36. Additional equipment such as pumps, additional heat exchangers, additional controllers and control features such as limits, etc. which would typically be associated with a cryogenic separation column have not been illustrated since these additional components play no part in the description of the present invention.

The liquid level controller 40 is operably connected to the tower 30 to control the liquid level therein. The controller 40 establishes an output signal 42 which is scaled to be representative of the flowrate in conduit 36 required to maintain the desired liquid level in column 30. Signal 42 is provided a set point signal to flow controller 44. Flow transducer 46 in combination with a flow sensor operably located in conduit 36 provides an output signal 48 which is representative of the actual flow rate of fluid in conduit 36. Signal 48 is provided from flow transducer 46 as a process variable input to flow controller 44. In response to signals 42 and 48 flow controller 44 provides an output signal 50 which is responsive to the difference between signals 42 and 48. Signal 50 is scaled to be representative of the position of control valve 52 required to maintain the desired flowrate represented by signal 42.

Temperature transducer 54 in combination with a measuring device such as a thermocouple operably located in conduit 36 provides an output signal 58 which is representative of the actual temperature of liquid flowing in conduit 36. Signal 58 is provided as a first input to the ratio calculator 51. Ratio calculator 51 is also provided with a second temperature signal 56 representative of the temperature of fluid flowing into conduit 38. Signal 56 originates in temperature transducer 52 whose output signal 56 is responsive to a sensing element such as a thermocouple operably located in conduit 38. In response to signals 56 and 58 ratio calculator 51 provides an output signal 60 which is representative of the ratio of signals 56 and 58. Signal 60 is provided as an input to ratio controller 66. Ratio controller 66 is also provided with a set point signal 68 which is representative of the desired temperature ratio for the fluids flowing in conduits 36 and 38. Responsive to signals 60 and 68, ratio controller 66 provides an output signal 70 which is responsive to the difference between signals 60 and 68. Signal 70 is scaled to be representative of the position of control valve 74, which is operably located in by-pass conduit 72, required to maintain the desired ratio represented by set point signal 68. Control valve 74 is manipulated responsive to signal 70.

In accordance with the present invention and referring now to FIG. 2, where like reference numerals are used for elements shown in FIG. 1, an automatic start-up of column 30 is facilitated by high selector 82. It is noted that the set point 78 of temperature controller 76 is desirably set at a temperature compatible with the liquid in the column 30. On start-up however, the temperature in conduit 38 will be at or near ambient temperature. Accordingly connecting signal 80 directly to manipulate valve 86 would cause valve 86 to close and not allow flow of the warm dry gas to a cryogenic separation column 30 during startup. This problem is overcome by temporarily selecting signal 96 to manipulate valve 86 as described below.

Responsive to signals 56 and 78 temperature controller 76 provides an output signal 80 responsive to the difference between signals 56 and 78. Signal 80 is scaled to be representative of the position of control valve 86 which is operably located in conduit 14 required to maintain the actual temperature of the fluid in conduit 38 substantially equal to the desired temperature representative by signal 78. As previously stated, however, the desired value for set point signal 78 will not allow start-up of the column. Accordingly signal 80 is provided to a signal selector 82. Signal selector 82 is also provided with a control signal 96 which is responsive to the difference between signals 91 and 94 and is scaled to be representative of the position of control valve 86 required to maintain the temperature of fluid in conduit 37 substantially equal to the desired temperature represented by signal 94. On start-up of the column, the actual temperature of fluid in conduit 37 will be less than the desired temperature represented by signal 94. Accordingly, connecting signal 96 to valve 86 would cause valve 86 to open so as to lower the temperature represented by signal 56. High selector 82 decides which of the control signals 96 and 80 manipulate the valve 86.

Start-up proceeds like this. Feed gas is introduced into the top of the cryogenic separation column 30 in the upper section. When the temperature of the feed gas cools to the condensing temperature of the impurity to be removed, liquid begins to build a level in the column 30. Level controller 40 senses the level and its output opens valve 52 responsive to signal 50. Low temperature liquid is then passed to heat exchanger 10 and exchanges heat with a warm dry gas stream through conduit 14 and valve 86. Valve 86 is initially opened by signal 96 on set point temperature. After dry gas flow is initiated temperature transducer 52 senses a sharply colder temperature resulting in signal 80 being selected by the high selector 82. The start-up controls assist the operator in providing a smooth safe start-up and reduce the level of human attention required.

While the invention has been described in terms of the presently preferred embodiment, reasonable variations and modifications are possible by those skilled in the art and such modifications and variations are within the scope of the described invention and the appended claims.

That which is claimed:

1. Apparatus comprising:

a) a cryogenic separation column for partially condensing a feed gas stream in an LNG recovery process;

b) means for withdrawing a liquid condensate stream from said cryogenic separation column;

c) a heat exchanger associated with said cryogenic separation column;

d) means for passing said liquid condensate stream through said heat exchanger;

e) means for passing a warm dry gas stream through said heat exchanger and thereafter to said cryogenic separation column, wherein said warm dry gas stream is cooled by indirect heat exchange with said liquid condensate stream in said heat exchanger;

f) a bypass conduit having a first control valve operably located therein for bypassing said warm dry gas stream around said heat exchanger;

g) means for establishing a first signal representative of the actual temperature of said warm dry gas stream exiting said heat exchanger;

h) means for establishing a second signal representative of the actual temperature of said liquid condensate stream entering said heat exchanger;

i) means for dividing said first signal by said second signal to establish a third signal representative of the ratio of said first signal and said second signal;

j) means for establishing a fourth signal representative of a desired value for the ratio represented by said third signal;

k) means for comparing said third signal and said fourth signal and establishing a fifth signal which is responsive to the difference of said third signal and said fourth signal, wherein said fifth signal is scaled to be representative of the position of said first control valve required to maintain the actual ratio represented by said third signal substantially equal to the desired ratio represented by said fourth signal; and m) means for manipulating said first control valve in said bypass conduit in response to said fifth signal.

2. Apparatus in accordance with claim 1, additionally comprising:

means for establishing a sixth signal scaled to be representative of the flow rate of said liquid condensate stream required to maintain a desired liquid level in said cryogenic separation column; and means for controlling the flow rate of said liquid condensate stream responsive to said sixth signal.

3. Apparatus in accordance with claim 2, additionally comprising:

a second control valve operably located so as to control flow of said warm dry gas stream; and means for manipulating said second control valve responsive to a temperature selected from the pair of temperatures consisting of:

i. the actual temperature of said warm dry gas stream exiting said heat exchanger; and ii. the actual temperature of said liquid condensate stream exiting said heat exchanger.

4. Apparatus in accordance with claim 3, wherein said means for manipulating said second control valve comprises:

means for establishing a seventh signal representative of the actual temperature of said liquid condensate stream exiting said heat exchanger;

means for establishing an eighth signal representative of the desired temperature of said liquid condensate stream exiting said heat exchanger;

means for comparing said seventh signal and said eighth signal to establish a ninth signal responsive to the difference of said seventh signal and said eighth signal, wherein said ninth signal is scaled to be representative of the position of said second control valve required to maintain the actual temperature of said liquid condensate stream exiting said heat exchanger represented by said seventh signal substantially equal to the desired temperature represented by said eighth signal;

means for establishing a tenth signal representative of the desired temperature of said warm dry gas stream exiting said heat exchanger represented by said second signal;

means for comparing said second signal and said tenth signal to establish an eleventh signal responsive to the difference between said second signal and said tenth signal, wherein said eleventh signal is scaled to be representative of the position of said second control valve required to maintain the actual temperature of said warm dry gas stream exiting said heat exchanger substantially equal to the desired value represented by said tenth signal;

means for establishing a twelfth signal selected as the one of said ninth signal and said eleventh signal having the higher value; and means for manipulating said second control valve responsive to said twelfth signal.

5. A method for controlling temperature in a heat exchanger equipped with a bypass conduit having a first control valve operatively connected therein, said heat exchanger being associated with a cryogenic separation column that removes a benzene contaminant from a feed stream in and LNG recovery process, said method comprising:

withdrawing a liquid condensate stream at a cryogenic temperature from said cryogenic separation column;

passing said liquid condensate stream through said heat exchanger;

passing a warm dry gas stream through said heat exchanger and thereafter introducing said warm dry gas stream into said cryogenic separation column, wherein said warm dry gas stream is cooled by indirect heat exchange with said liquid condensate stream in said heat exchanger;

establishing a first signal representative of the actual temperature of said warm dry gas stream exiting said heat exchanger;

establishing a second signal representative of the actual temperature of said liquid condensate stream entering said heat exchanger;

dividing said first signal by said second signal to establish a third signal representative of the ratio of said first signal and said second signal;

establishing a fourth signal representative of a desired value for said third signal;

comparing said third signal and said fourth signal and establishing a fifth signal which is responsive to the difference between said third signal and said fourth signal, wherein said fifth signal is scaled to be representative of the position of said first control valve required to maintain the actual ratio represented by said third signal substantially equal to the desired ratio represented by said fourth signal; and manipulating said first control valve in said bypass conduit in response to said fifth signal.

6. A method in accordance with claim 5 additionally comprising the following steps:

establishing a sixth signal scaled to be representative of the flow rate of said liquid condensate steam required to maintain a desired liquid level in said cryogenic separation column; and controlling the flow rate of said liquid condensate stream responsive to said sixth signal.

7. A method in accordance with claim 6, wherein a second control valve is operably located so as to control flow rate of said warm dry gas stream, said method additionally comprising the following steps:

manipulating said second control valve responsive to a temperature selected from the pair of temperatures consisting of:

i) the actual temperature of said warm dry gas stream exiting said heat exchanger; and ii) the actual temperature of said liquid condensate stream exiting said heat exchanger.

8. A method in accordance with claim 7, wherein said step of manipulating said second control valve comprises:

establishing a seventh signal representative of the actual temperature of said liquid condensate stream exiting said heat exchanger;

establishing an eighth signal representative of the desired temperature of said liquid condensate stream exiting said heat exchanger;

comparing said seventh signal and said eighth signal to establish a ninth signal responsive to the difference between said seventh signal and said eighth signal, wherein said ninth signal is scaled to be representative of the position of said second control valve required to maintain the actual temperature of said liquid condensate stream exiting said heat exchanger represented by said seventh signal substantially equal to the desired temperature represented by said eighth signal;

establishing a tenth signal representative of the desired temperature of said warm dry gas stream exiting said heat exchanger represented by said second signal;

comparing said second signal and said tenth signal to establish an eleventh signal responsive to the difference between said second signal and said tenth signal, wherein said eleventh signal is scaled to be representative of the position of said second control valve required to maintain the actual temperature of said warm dry gas stream exiting said heat exchanger substantially equal to the desired value represented by said tenth signal;

establishing a twelfth signal selected as the one of said ninth signal and said eleventh signal having the higher value; and manipulating said second control valve responsive to said twelfth signal.

* * * * *